US006311939B1

(12) United States Patent
Christensen

(10) Patent No.: US 6,311,939 B1
(45) Date of Patent: Nov. 6, 2001

(54) INTEGRATED MOUSE PAD AND WRIST AND ARM SUPPORT

(76) Inventor: Leslie Palmatier Christensen, 6864 B Brindle Heath Way, Alexandria, VA (US) 22315

( * ) Notice: Subject to any disclaimer, the term of this patent is extended or adjusted under 35 U.S.C. 154(b) by 0 days.

(21) Appl. No.: 09/604,451

(22) Filed: Jun. 27, 2000

Related U.S. Application Data

(62) Division of application No. 08/971,676, filed on Nov. 17, 1997, now Pat. No. 5,918,840, which is a continuation of application No. 08/521,657, filed on Aug. 31, 1995, now Pat. No. 5,727,759.

(51) Int. Cl.[7] ..... B43L 5/00

(52) U.S. Cl. ..... 248/118.3; 248/289.11; 248/918; 297/411.23; 297/411.36

(58) Field of Search ..... 248/118, 118.3, 248/289.11, 918; 297/411.23, 411.36, 411.27, 411.35, 411.37, 188.2, 188.21

(56) References Cited

U.S. PATENT DOCUMENTS

| | | | | |
|---|---|---|---|---|
| 1,007,590 | | 10/1911 | Miller . | |
| 2,477,898 | | 8/1949 | Rehman et al. . | |
| 2,659,423 | | 11/1953 | Haley . | |
| 3,140,119 | | 7/1964 | Offner . | |
| 4,576,351 | | 3/1986 | Brink . | |
| 4,822,103 | | 4/1989 | Stenvall . | |
| 4,913,393 | | 4/1990 | Wood . | |
| 4,961,610 | | 10/1990 | Reeder . | |
| 5,338,133 | | 8/1994 | Tornero . | |
| 5,407,249 | | 4/1995 | Bonutti . | |
| 5,439,268 | | 8/1995 | Dozsa-Farkus . | |
| 5,513,898 | | 5/1996 | Kanai et al. . | |
| 5,641,203 | | 6/1997 | Van De Ricet et al. . | |
| 5,653,499 | * | 8/1997 | Goodall | 297/170 |
| 5,727,759 | * | 3/1998 | Christensen | 248/118 |
| 5,749,628 | * | 5/1998 | Synder et al. | 297/411.36 |
| 5,752,683 | * | 5/1998 | Novis et al. | 248/118 |
| 5,816,556 | * | 10/1998 | Liao | 248/405 |
| 5,876,097 | * | 3/1999 | Cao | 297/411.37 |
| 5,884,976 | * | 3/1999 | Breen et al. | 297/411.37 |
| 5,927,810 | * | 7/1999 | Liao | 297/344.12 |
| 5,944,386 | * | 8/1999 | Yamagishi et al. | 297/411.31 |
| 6,017,091 | * | 1/2000 | Cao | 297/411.37 |
| 6,142,570 | * | 11/2000 | Bergsten et al. | 297/411.35 |

* cited by examiner

*Primary Examiner*—Ramon O. Ramirez
*Assistant Examiner*—S Marsh

(57) ABSTRACT

An integrated mouse pad and wrist and arm support which can be attached to a desk chair and which provides support for both the wrist and arm of a computer operator. The device provides a support arm with a mouse pad at one end and enables the user's wrist and arm to rest at approximately the same level as the mouse pad. Use of the device reduces stress to the wrist, arm, shoulder and neck during use of the mouse. The device is attached to the chair by an attachment member, the height of which can be adjusted as desired by the operator. The angular position of the support arm with respect to the operator can be adjusted to a selected ergonomic position. In one embodiment, the length of the support arm can be adjusted to a selected ergonomic position.

4 Claims, 5 Drawing Sheets

INTEGRATED MOUSE PAD AND WRIST AND ARM SUPPORT

CROSS REFERENCE TO RELATED APPLICATIONS

This application is a division of application Ser. No. 08/971,676, filed Nov. 17, 1997, now U.S. Pat. No. 5,918,840, granted Jul. 6, 1999 which is a continuation of application Ser. No. 08/521,657, filed Aug. 31, 1995, now U.S. Pat. No. 5,727,759, granted Mar. 17, 1998.

BACKGROUND OF THE INVENTION

1. Field of the Invention

This invention relates to a mouse pad having a support member associated with the mouse pad and which extends from the mouse pad to provide support for the user's wrist and arm. It also allows the user to sit comfortably in their chair with their back resting against the back of the chair (proper ergonomic posture) while operating the mouse. The integrated mouse pad and support member is configured so as to be attachable to a chair in which the user sits when using the mouse pad while operating a computer.

2. Description of the Prior Art

There is growing concern about the need for comfortable positioning of the wrist and arm of a user of a computer mouse and for the need to maintain the proper back posture in the chair while inputting text and data to a computer. Manipulation of the mouse requires the use of both wrist and arm movements, and often leaning forward to reach the mouse on the desktop. The mouse is placed on a mouse pad which is positioned somewhere near the keyboard and the user must often perform many mouse operations during a given day of using the computer, each operation requiring that the mouse be grasped, moved, and clicked. These operations currently must be performed without adequate support for the wrist and arm of the user, resulting in muscle and tendon strain that can lead to discomfort or even permanent injury. Also, when the user is forced to lean toward their desk to reach the mouse the user is not sitting properly in their chair. Thus, other problems such as shoulder, neck and back strain can result.

SUMMARY OF THE INVENTION

In order to provide support for the wrist, arm, and back of the user of the mouse, a mouse pad having an integrated support member is provided. The support member and the mouse pad are constructed using either a one-piece or a two-piece configuration with the support member extending from the mouse pad toward the user permitting the user to rest the wrist and forearm on the support member. The mouse pad with integrated support member is attachable to a chair using an attaching member, the height of which can be adjusted. The angular position of the mouse pad and integrated support member relative to the user can be adjusted to a selected ergonomic position and locked in place by means of a positioning platform and associated positioning pin, positioning holes, and a spring-loaded plunger bolt.

DETAILED DESCRIPTION OF THE INVENTION

The detailed description will hereunder be given of the preferred embodiment of the integrated mouse pad and wrist and arm support with positioning and attaching assemblies with reference to the accompanying drawings.

Figure 1:
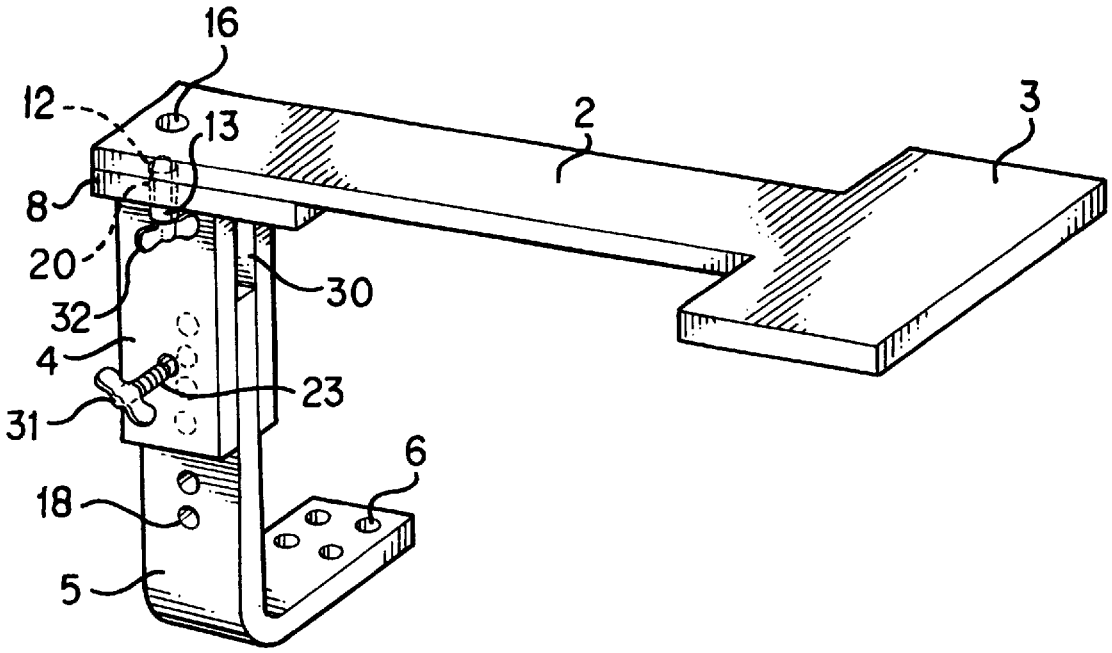
FIG. 1 is a perspective view showing the integrated mouse pad and one-piece wrist and arm support member, along with the positioning platform and the attaching member.
Figure 2:
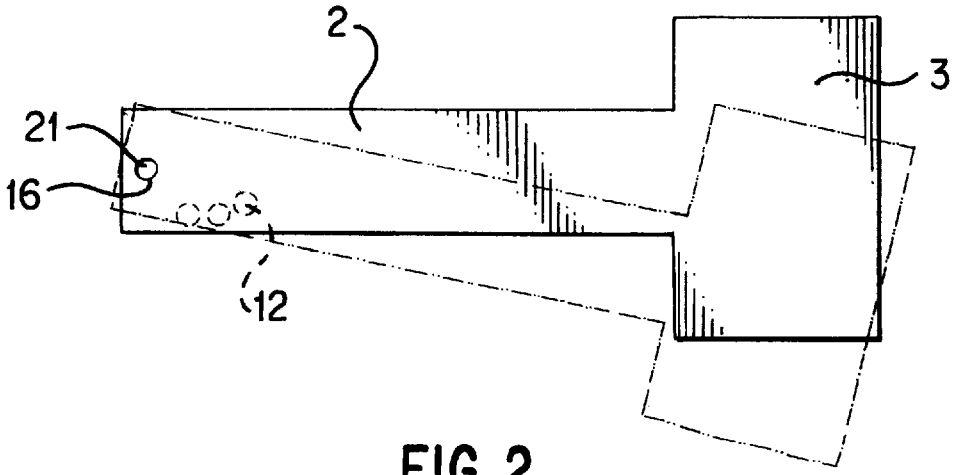
FIG. 2 is a top view showing adjustable positioning of the mouse pad and integrated wrist and arm support.

FIG. 1 shows a mouse pad portion 3 and a support member portion 2 which are formed as an integral, one-piece platform, the top surface of which forms a common plane forming a surface for a mouse pad. The support member 2 provides support for the wrist and arm of the user of a mouse which is typically placed on the mouse pad portion during operation of a computer. A means for attaching the integrated mouse pad and wrist and arm support to a chair is provided in the form of a two-piece metal attaching means comprising a first attaching member 4 and a second attaching member 5. The first attaching member 4 is attached, at its top end, to a positioning platform 8 which mates with the support member portion 2 at the end which is opposite to the end which forms the mouse pad. The first attaching member 4 extends downward from the positioning platform 8 and has a slot 30 for receiving the second attaching member 5. The first and second attaching members are attached by means of an adjustable connection. This adjustable connection is provided in the form of a plurality of holes 18 which are drilled through the second attaching member and which receive a bolt attached to a spring-loaded plunger 23. By means of the plurality of holes 18 and the bolt and the spring-loaded plunger 23, the height of the positioning platform is made adjustable by pulling on the handle 31 of spring-loaded plunger 23, sliding the first attaching member 4 and the second attaching member 5 relative to each other, and releasing the handle 31 to move the bolt into one of the holes 18. The handle 31 of the spring-loaded plunger 23 is configured so as to permit easy gripping by the fingers of the user. The second attaching member 5 is affixed to a chair.

As seen in FIGS. 1, 2, 3, 6, and 7 the angular position of the support member portion 2 relative to the user is made adjustable to a selected ergonomic position by means of a positioning platform 8, swivel pin 21, positioning hole 16, position adjustment holes 12, locking hole 20, and spring-loaded plunger 13. The positioning platform 8 is a flat piece with a swivel pin 21 extending upward from the top surface and used to mate with a swivel pin positioning hole 16 in the support member portion 2. A plurality of position adjustment holes 12 are partially drilled in the underside of the support member portion 2 near the inside and outside sides thereof The first attaching member 4 is attached to the bottom of the positioning platform 8. Locking hole 20 is drilled through the positioning platform 8.

The support member portion 2 is positioned for use by mating it with the positioning platform 8 such that the swivel pin 21 of the positioning platform 8 fits into the swivel pin positioning hole 16 of the support member portion 2. The support member portion 2 is then swiveled about the swivel pin 21 until one of its position adjustment holes 12 lines up with locking hole 20 located near the outside edge of the positioning platform 8. A spring-loaded plunger bolt mechanism 13 having a handle 32 contoured for gripping by two fingers of the user without the thumb is used as a locking means and is attached to the underside of the positioning platform 8 so that it can insert a bolt 10 through the locking hole 20 from the positioning platform 8 into one of the position adjustment holes 12 in order to secure the desired angle of the support member 2.

As a second embodiment, the integrated mouse pad and wrist and arm support may be configured so as to permit installation on the left side of a chair. In such a configuration, the integral one-piece platform, including support member 2 and mouse pad portion 3 is attached to the positioning platform 8 in the opposite direction to allow installation and use on the left side of the chair.

Figure 3:
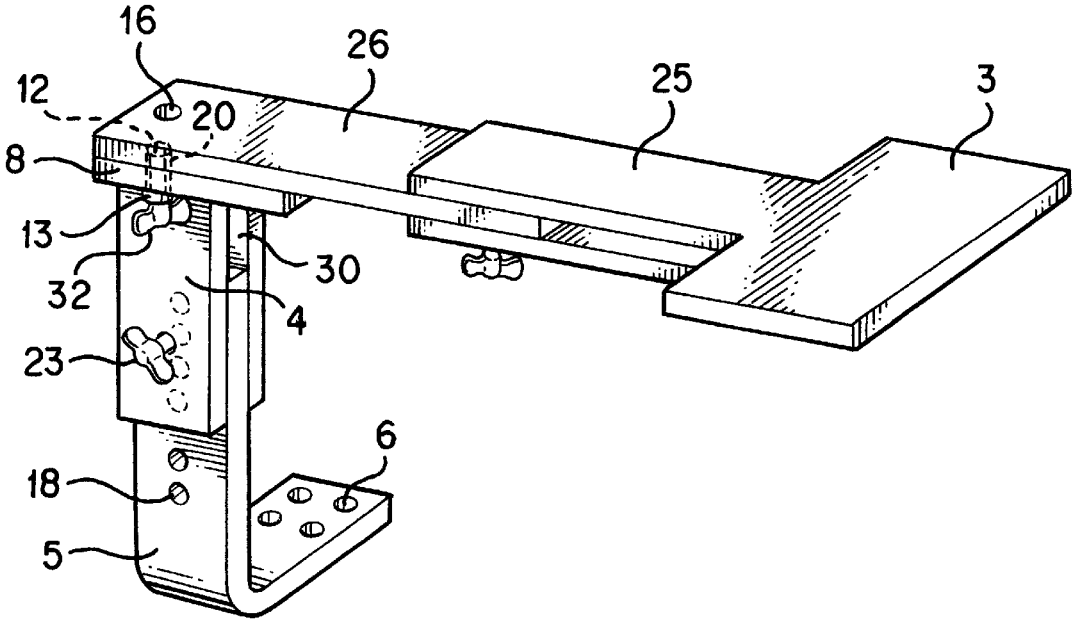
FIG. 3 is a perspective view showing the integrated mouse pad and two-piece wrist and arm support member, along with the positioning platform and attaching member.

FIG. 3, as a third embodiment, presents an alternative means for constructing the support member portion 2. In this embodiment the support member portion is configured to have a first member 25 and a second member 26, with the second member 26 being slidably fitted with the first member 25 so as to enable adjustment in the overall length of the support member portion. Its construction is similar to that of the mating of first attaching member 4 and second attaching member 5 described earlier.

Figure 4:
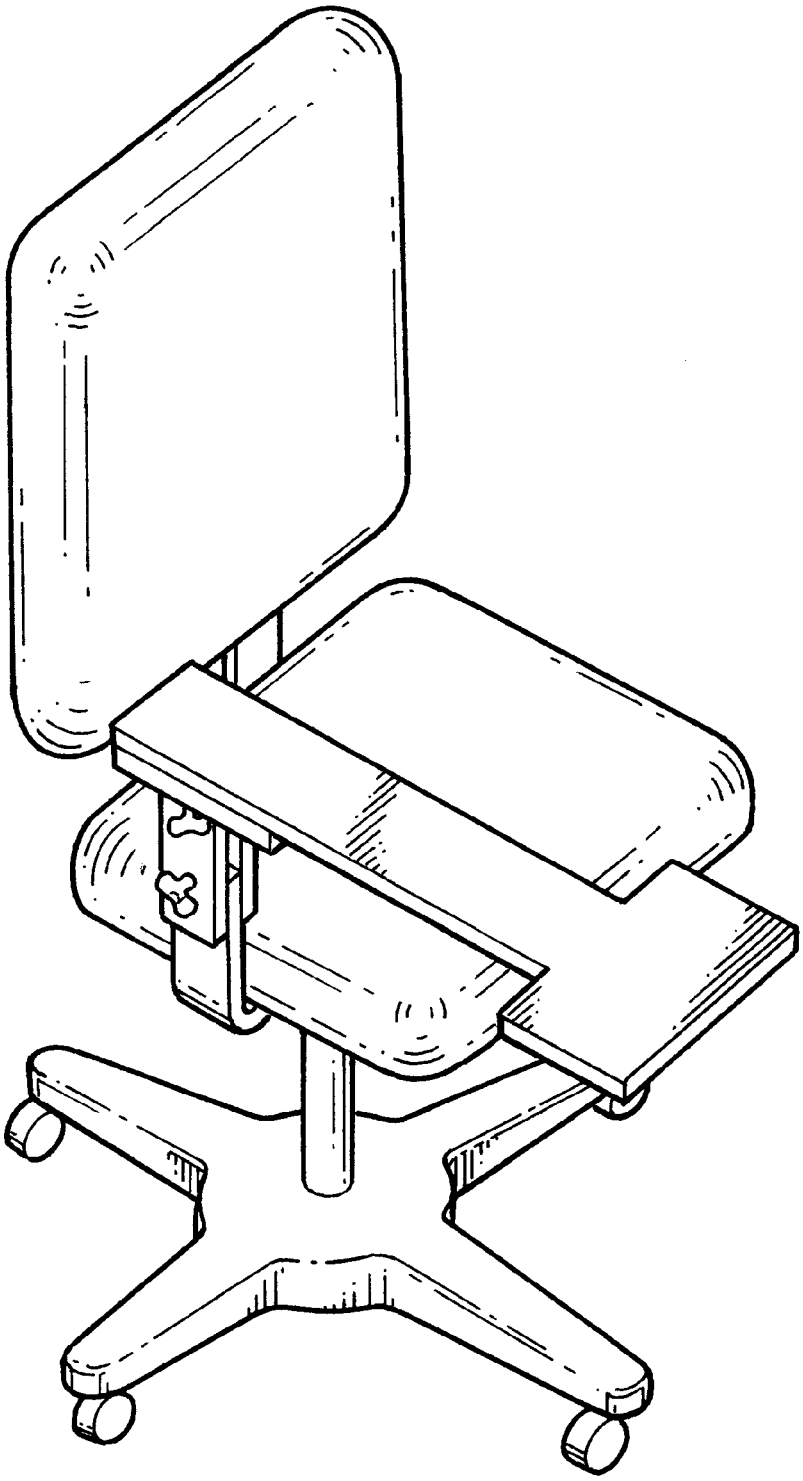
FIG. 4 is a perspective view showing the integrated mouse pad and wrist and arm support attached to a chair.
Figure 5:
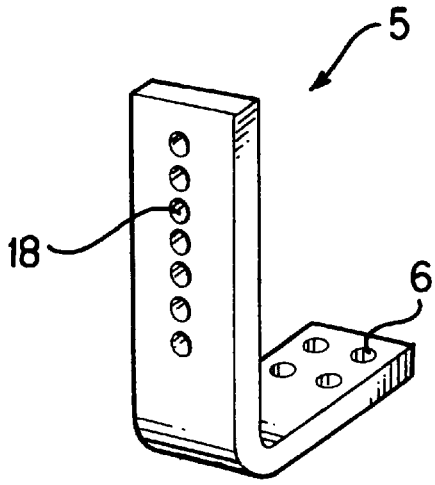
FIG. 5 is a diagram of the second attaching member.
Figure 6:
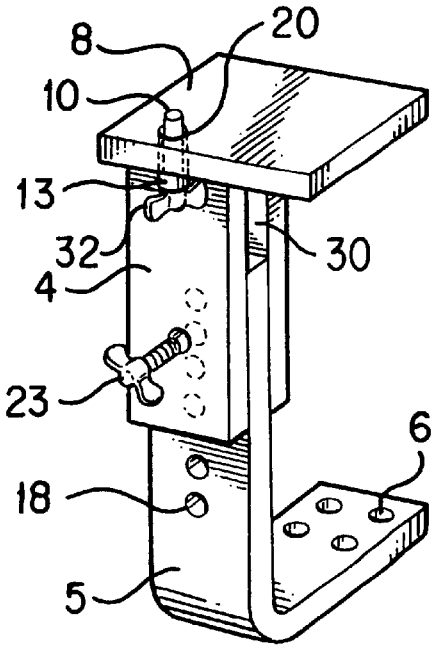
FIG. 6 is a diagram showing the inter-relationship of first and second vertical attaching members and positioning platform.
Figure 7:
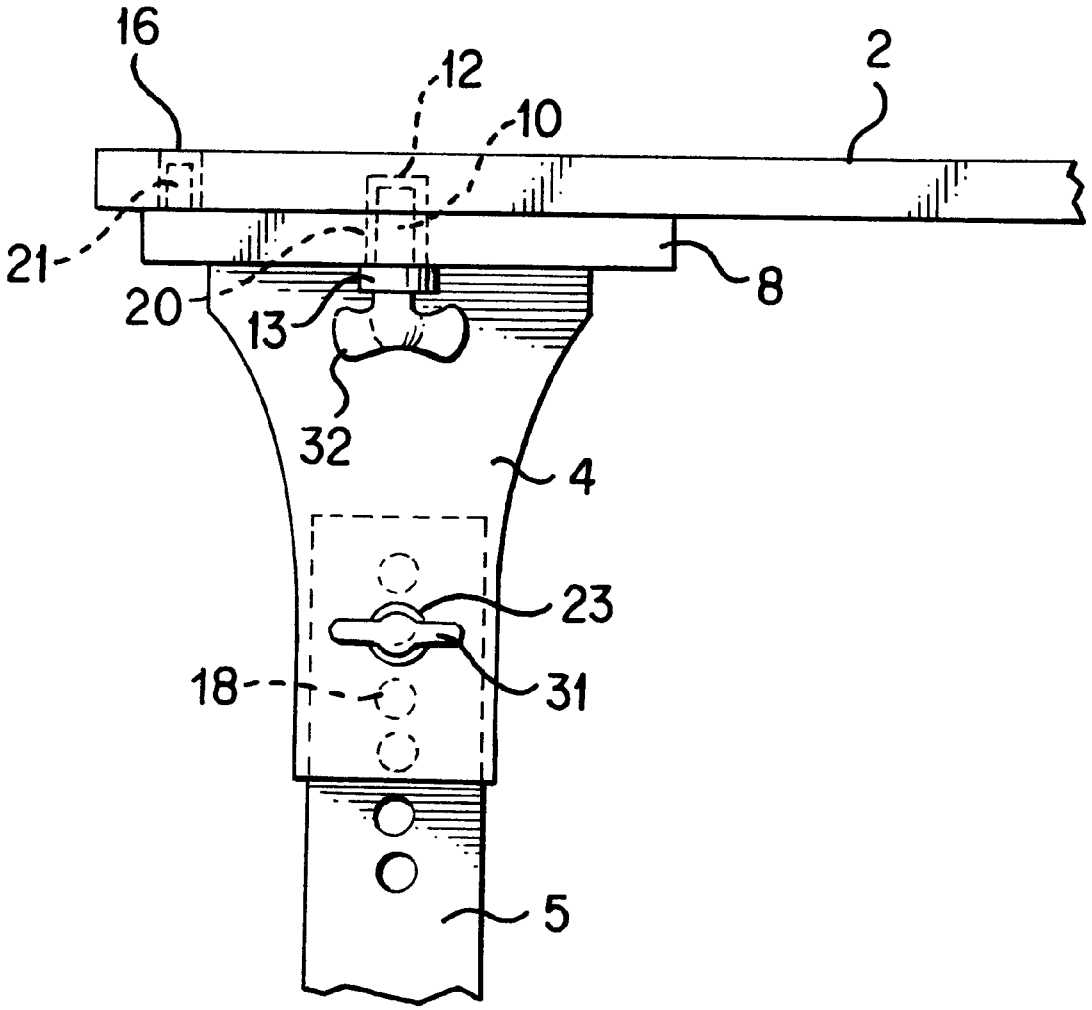
FIG. 7 shows a detailed view of the interconnections between the various positioning components.

FIG. 4 shows the integrated mouse pad and wrist and arm support assembly attached to a chair and ready for use.

Although illustrative embodiments of the invention have been described with reference to the accompanying drawings, it is to be understood that the invention is not limited to those precise embodiments, and that various changes and modifications can be effected therein by one skilled in the art without departing from the scope and spirit of the invention as defined by the appended claims. For instance the second attaching member 5 may be adapted to permit attachment of the integrated mouse pad and wrist and arm support to any chair in a manner required by the way the arm of the chair is attached to the body of the chair by the chair's manufacturer. Such adaptation is well within the ability of one skilled in the art and does not depart from the scope and spirit of the present invention.

What is claimed is:

1. An integrated mouse pad and wrist and arm support with positioning and attaching assemblies, comprising:

a support arm formed as an elongated member having first and second ends and an inside and an outside edge, the shape of said elongated member being that of an elongated rectangle except at said first end, said first end being shaped to be larger in size than said second end, said first end being configured in the shape of a computer mouse pad and comprising a mouse pad portion of said elongated member, the remainder of said elongated member comprising a wrist and arm support member portion;

a positioning assembly comprising a positioning platform, a swivel pin extending upward from said positioning platform, a swivel pin positioning hole located in said wrist and arm support member portion near said second end, a plurality of position adjustment holes located in the underside of said wrist and arm support member portion near said inside and outside edges, a locking hole located in said positioning platform, and a spring-loaded plunger bolt means, said spring-loaded plunger bolt means having a handle contoured so as to enable being pulled by two fingers of a user without the thumb, said swivel pin configured to mate with said swivel pin positioning hole, said spring-loaded plunger bolt means configured to move a bolt into one of said position adjustment holes through said locking hole, said positioning assembly thus permitting an angular positioning adjustment of said wrist and arm support member portion; and an attaching assembly for attaching said integrated mouse pad and wrist and arm support and positioning assembly to a chair, said attaching assembly comprising first and second vertical attaching members, said first vertical attaching member having an upper end permanently attached to said positioning platform, said second vertical attaching member having a lower portion enabling attachment to a chair, said first vertical attaching member and second vertical attaching member being slidably attached to each other.

2. An integrated mouse pad and wrist and arm support as claimed in claim 1, wherein said first vertical attaching member has a slot for receiving said second vertical attaching member and a hole therethrough, and a spring-loaded plunger bolt means mounted thereon for moving a bolt into one of a plurality of holes of said second vertical attaching member so as to lock said second vertical attaching member into a vertical position relative to said first vertical attaching member.

3. An integrated mouse pad and wrist and arm support as claimed in claim 1, wherein said elongated member is configured so as to be selectively attached to said positioning platform in a direction facilitating use from either a right or a left side of said chair.

4. An integrated mouse pad and wrist and arm support as claimed in claim 1, wherein said elongated member is configured as first and second parts, said first and second parts being configured so as to slidably attach to each other in a way permitting an adjustment of the length of said elongated member.

* * * * *